US006923672B1

(12) United States Patent
Chen

(10) Patent No.: US 6,923,672 B1
(45) Date of Patent: Aug. 2, 2005

(54) PATCH PLUG

(75) Inventor: Michael Chen, Keelung (TW)

(73) Assignee: Surtec Industries Inc., Keelung (TW)

( * ) Notice: Subject to any disclaimer, the term of this patent is extended or adjusted under 35 U.S.C. 154(b) by 0 days.

(21) Appl. No.: 10/824,494

(22) Filed: Apr. 15, 2004

(51) Int. Cl.[7] ..... H01R 4/24
(52) U.S. Cl. ..... 439/404
(58) Field of Search ..... 439/404, 418, 439/676, 941, 638, 405

(56) References Cited

U.S. PATENT DOCUMENTS 5,911,594 A * 6/1999 Baker et al. ..... 439/404
5,915,989 A * 6/1999 Adriaenssens et al. ..... 439/404
5,941,734 A * 8/1999 Ikeda et al. ..... 439/676
5,967,828 A * 10/1999 Geurts et al. ..... 439/418
6,010,353 A * 1/2000 Ensz et al. ..... 439/404
6,062,895 A * 5/2000 Lin et al. ..... 439/404
6,065,994 A * 5/2000 Hashim et al. ..... 439/404
6,066,005 A * 5/2000 Belopolsky ..... 439/676
6,068,504 A * 5/2000 Gardner et al. ..... 439/405
6,186,834 B1 * 2/2001 Arnett et al. ..... 439/676
6,193,542 B1 * 2/2001 Marowsky et al. ..... 439/418
6,547,604 B2 * 4/2003 Arnett et al. ..... 439/676

* cited by examiner

*Primary Examiner*—Ross Gushi
*Assistant Examiner*—Phuongchi Nguyen
(74) *Attorney, Agent, or Firm*—Harness, Dickey & Pierce, PLC

(57) ABSTRACT

A patch plug includes pairs of electrical conductors close one another. The electrical conductors of each pair have an interval smaller than the interval of two neighboring pairs of electrical conductors. At least one pair of the electrical conductors are crossed so that two neighboring pairs of electrical conductors that have the same electricity are close to each other to generate capacitance compensation thereby to enable the patch plug to conform to Category 6 standards.

13 Claims, 5 Drawing Sheets

PATCH PLUG

FIELD OF THE INVENTION

The present invention relates to a path plug for transmitting high-speed electric signals and particularly to a patch plug that conforms to EIA/TIA Category 6 standards.

BACKGROUND OF THE INVENTION

In response to the high-speed network applications beyond Ethernet, the working groups of Telecommunication Industry Associations (TIA) of U.S.A. published Category 6 standards (ANSI/TIA/EIA-568-B.2-1) in June of 2000. The category 6 standards, besides expanding from 100 MHz of Category 5 standards to 200 MHz, also require the performance to be enhanced at least 25% over the Category 5 standards. Some performance test frequency for Category 6 even reaches 250 MHz. The biggest difference between the Category 6 and Category 5 standards is the performance improvement on crosstalk and return loss. For the new generation of full duplex high-speed network applications, good return loss performance is very important. The crosstalk performance is an important factor to control frequency bandwidth. Although 100 Mbps is still the main stream of the present network configurations, the Category 6 standards will be more desirable to meet future requirements.

The standards set forth above not merely target high-speed communication wires. In order to maintain high-speed transmission performance in the high-speed communication network systems, the peripheral equipment related to the high-speed communication wires, especially telecommunication connection elements (such as RJ-45 type plug and jack) also require a corresponding design. There are many types of connectors. The patch plug is one of them. Most connector products now on the market merely focus on the improvement of the jack portion. Very few focus on the improvement of the plug portion. Hence it often happens that the high-speed cables and jacks conform to the Category 6 standards, but the plug portions have too much interference. As a result, the total system still can reach only the Category 5 standards or even lower.

To remedy this problem, U.S. Pat. No. 6,062,895 discloses a patch plug with contact blades, that has pairs of spaced electrical conductors close to each other so that the interval is shrunk and is moved away from the neighboring electrical conductors to reduce crosstalk and interference of telecommunication signals. However, such a compensation scheme still cannot reach the EIA/TIA Category 6 standards.

SUMMARY OF THE INVENTION

The object of the invention is to provide a patch plug to conform to ANSI/TIA/EIA-568-B.2-1/Category 6 transmission standards (hereinafter called EIA/TIA Category 6 standards).

The patch plug according to the invention includes a shell and a plurality of electrical conductors. The shell has a housing space, which has one end to receive a communication wire and another end containing a plurality of insertion slots to accommodate the electrical conductors. Each of the electrical conductors has a contact portion at one end exposed outside the housing space and a piercing end at another end located in the housing space. The piercing end can contact the communication wire. The electric conductors are paired and defined in different electricity and laid in a spaced manner. The insertion slots can make the interval of every pair of electrical conductors smaller than the distance between the neighboring pairs of electrical conductors. And the piercing ends of at least one pair of the electrical conductors are crossed to abut onto the piercing ends of neighboring electrical conductors that have the same electricity, so that capacitance compensation is generated to conform to EIA/TIA Category 6 standards, thereby improving transmission quality and performance.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1A:
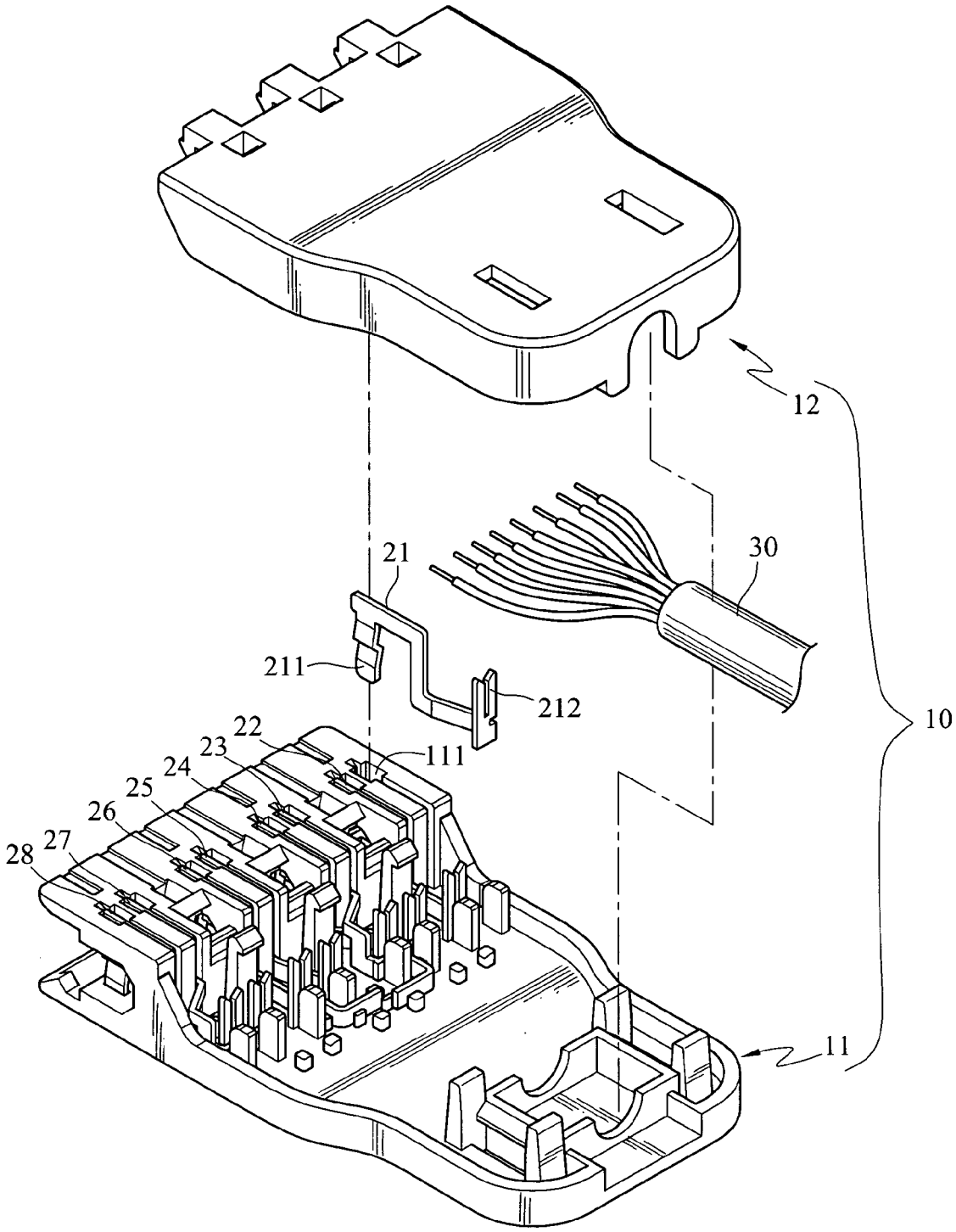
FIGS. 1A, 1B and 1C are schematic views of the invention.
Figure 1B:
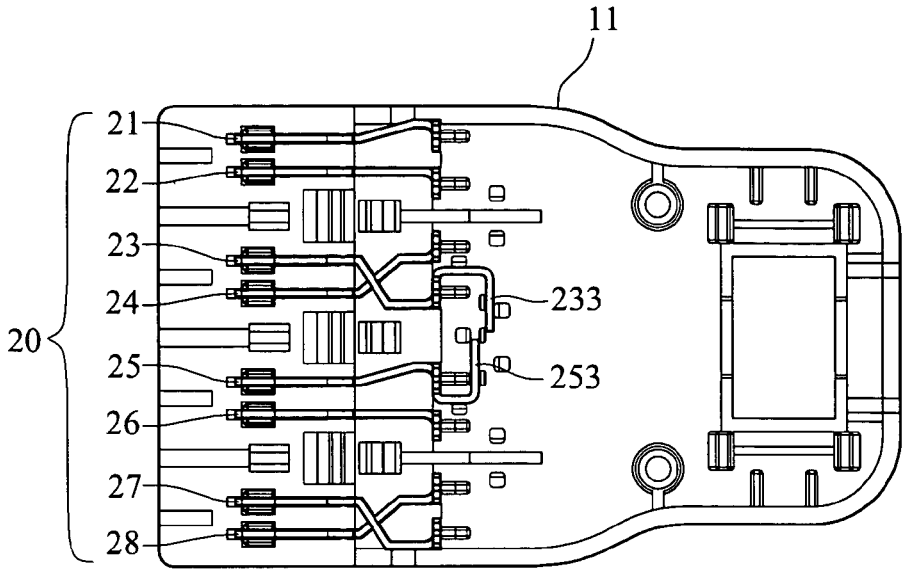
Figure 1C:
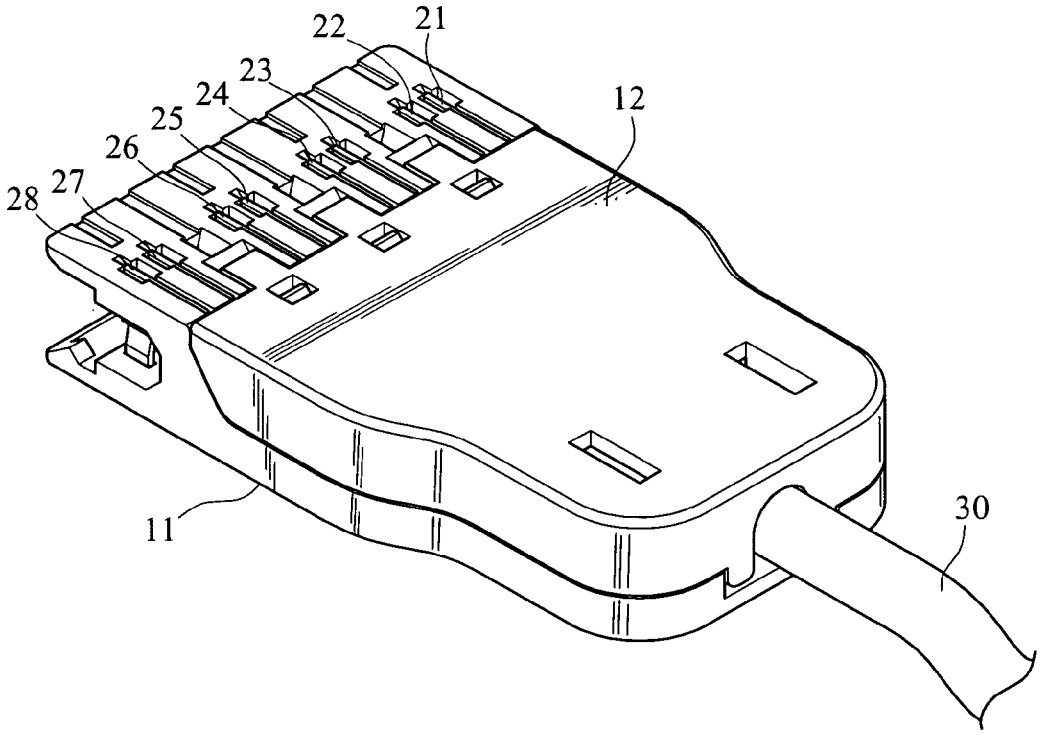

Referring to FIGS. 1A, 1B and 1C, the patch plug according to the invention includes a shell 10 and a plurality of electrical conductors 20. The shell 10 consists of a base 11 and a cap 12, and conforms to the 110-type structure. The base 11 and the cap 12 are coupled to form a housing space which has one end to allow a communication wire 30 to pass through and be held in the housing space and another end forming a plurality of insertion slots 111 to anchor the electrical conductors 20.

The electrical conductors 20 are formed in pairs, as shown in the drawings, include a first electrical conductor 21, a second electrical conductor 22, a third electrical conductor 23, a fourth electrical conductor 24, a fifth electrical conductor 25, a sixth electrical conductor 26, a seventh electrical conductor 27 and an eighth electrical conductor 28. They are similarly constructed. Take the first electrical conductor 21 as an example. It has one end exposed outside the shell 10 to form a contact portion 211 and another end formed a piercing end 212. The electrical conductors are paired. Namely, the first electrical conductor 21 and the second electrical conductor 22, the third electrical conductor 23 and the fourth electrical conductor 24, the fifth electrical conductor 25 and the sixth electrical conductor 26, the seventh electrical conductor 27 and the eighth electrical conductor 28 form respectively four pairs of electrical conductors. Through the insertion slots 111, the interval of each pair of electrical conductors is smaller than the interval of the neighboring pairs of electrical conductors. For instance, the interval of the third electrical conductor 23 and the fourth electrical conductor 24 is smaller than the interval of the third electrical conductor 23 and the second electrical conductor 22. The same principle is applied to the rest of the electrical conductors.

Meanwhile, the two electrical conductors of each pair have different electricity. For instance, if the first electrical conductor 21 is T (tip), the second electrical conductor 22 is R (ring). Similarly, if the third electrical conductor 23 is T (tip), and the fourth electrical conductor 24 is R (ring); the fifth electrical conductor 25 is T (tip), and the sixth electrical conductor 26 is R (ring); the seventh electrical conductor 27 is T (tip), and the eighth electrical conductor 28 is R (ring). Hence the T and R are arranged in an alternate manner. Furthermore, at least one pair has the piercing ends 212 crossed to be abutting neighboring electrical conductors of the same electricity. Refer to FIG. 1B for example. The third electrical conductor 23 and the fourth electrical conductor 24 are crossed so that the piercing end of the fourth electrical conductor 24 is abuts onto the second electrical conductor 22, and the piercing end of third electrical conductor 23 abuts onto the fifth electrical conductor 25. Thus the electrical conductors of the same electricity may be close to each other to generate capacitance compensation. Applying the foregoing example, the fourth electrical conductor 24 has an electricity of R, and the second electrical conductor 22 also has an electricity of R. The two electrical conductors are close to each other to generate an RR effect. On the other hand, the third electrical conductor 23 and the fifth electrical conductor 25 have the same electricity of T, therefore they generate a TT effect. The cross of the electrical conductors is preferably selected from the non-neighboring ones. For instance, also referring to FIG. 2, the seventh electrical conductor 27 crosses the eighth electrical conductor 28 so that the piercing ends of all electrical conductors of the same electricity abut one another. Similarly, crossing the first electrical conductor 21 with the second electrical conductor 22, and the fifth electrical conductor 25 with the sixth electrical conductor 26 also can generate the same effect. However, the capacitance compensation effect generated by simple crossing is limited. An improved approach elaborated below can further enhance the capacitance compensation effect for the patch plug to conform to EIA/TIA Category 6 standards.

Figure 2:
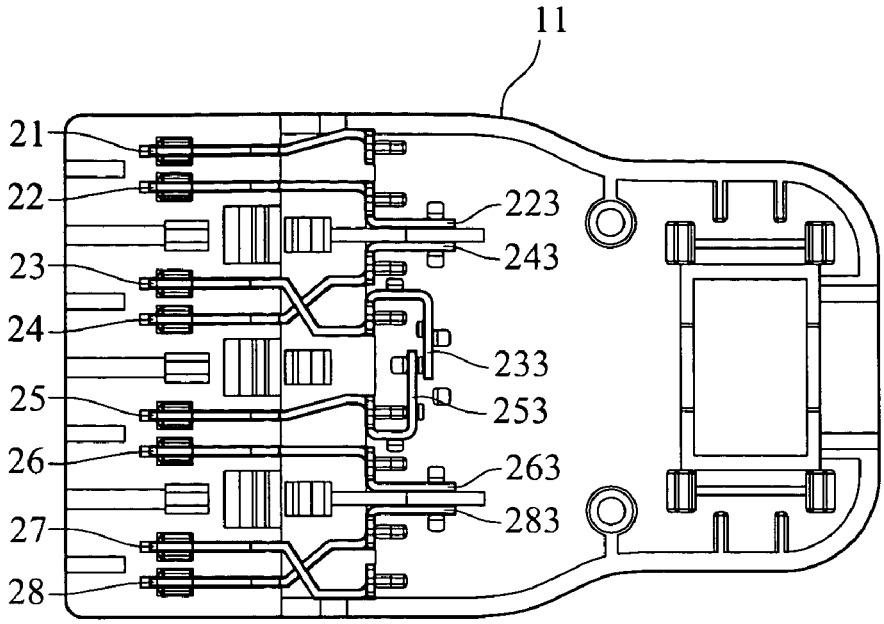
FIG. 2 is a schematic view of a first embodiment for capacitance compensation of the invention.

The approach is to make the rest electrical conductors in parallel spatially, to increase the capacitance compensation value. Refer to FIG. 2 for a first embodiment of the invention. In addition to the compensation mentioned above, the piercing end of the electrical conductors is extended to form an extension. As shown in the drawing, the second electrical conductor 22 has a distal end extended to form an extension 223; the third electrical conductor 23 has a distal end extended to form an extension 233; the fourth electrical conductor 24 has a distal end extended to form an extension 243; the fifth electrical conductor 25 has a distal end extended to form an extension 253; the sixth electrical conductor 26 has a distal end extended to form an extension 263; and the eight electrical conductor 28 has a distal end extended to form an extension 283. These extensions are located on the same horizontal surface and in parallel and close to each other. Namely, the extension 223 of the second electrical conductor 22 and the extension 243 of the fourth electrical conductor 24 are located on the same horizontal surface and are extended longitudinally upwards, close to-, and parallel with each other. The extension 233 of the third electrical conductor 23 and the extension 253 of the fifth electrical conductor 25 are located on the same horizontal surface and are extended longitudinally and close to-, and parallel with each other. The extension 263 of the sixth electrical conductor 26 and the extension 283 of the eighth electrical conductor 28 are located on the same horizontal surface and are extended longitudinally upwards and close to-, and parallel with each other. Such arrangements can greatly increase the capacitance compensation value to reach EIA/TIA Category 6 standards.

Figure 3:
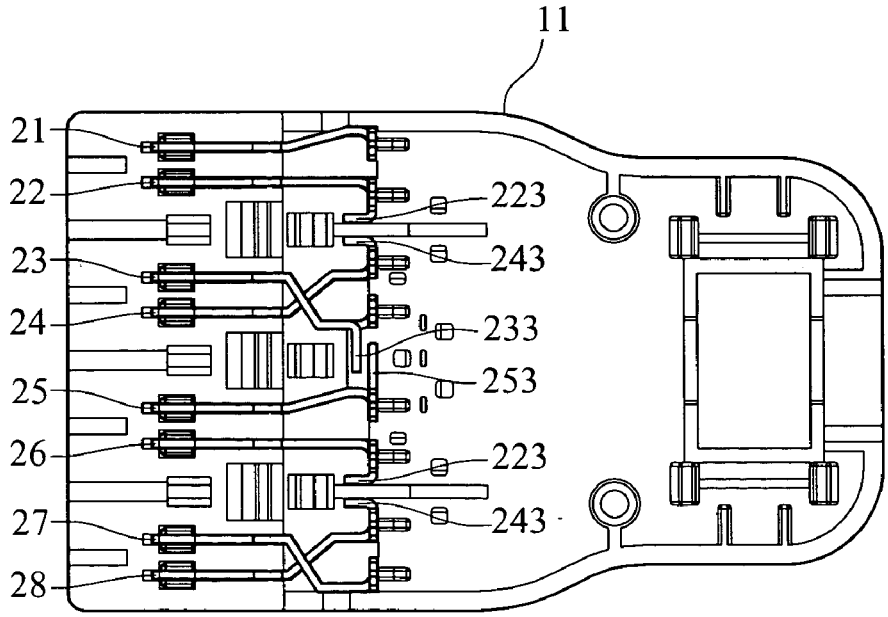
FIG. 3 is a schematic view of a second embodiment for capacitance compensation of the invention.

Refer to FIG. 3 for a second embodiment of the invention. The extension 223 of the second electrical conductor 22 and the extension 243 of the fourth electrical conductor 24 are located on the same horizontal surface and extended longitudinally downwards to be close to each other in parallel; the extension 233 of the third electrical conductor 23 and the extension 253 of the fifth electrical conductor 25 are located on the same horizontal surface and extended transversely to be close to each other in parallel; the extension 263 of the sixth electrical conductor 26 and the extension 283 of the eighth electrical conductor 28 are located on the same horizontal surface and extended longitudinally downwards to be close to each other in parallel.

Figure 4A:
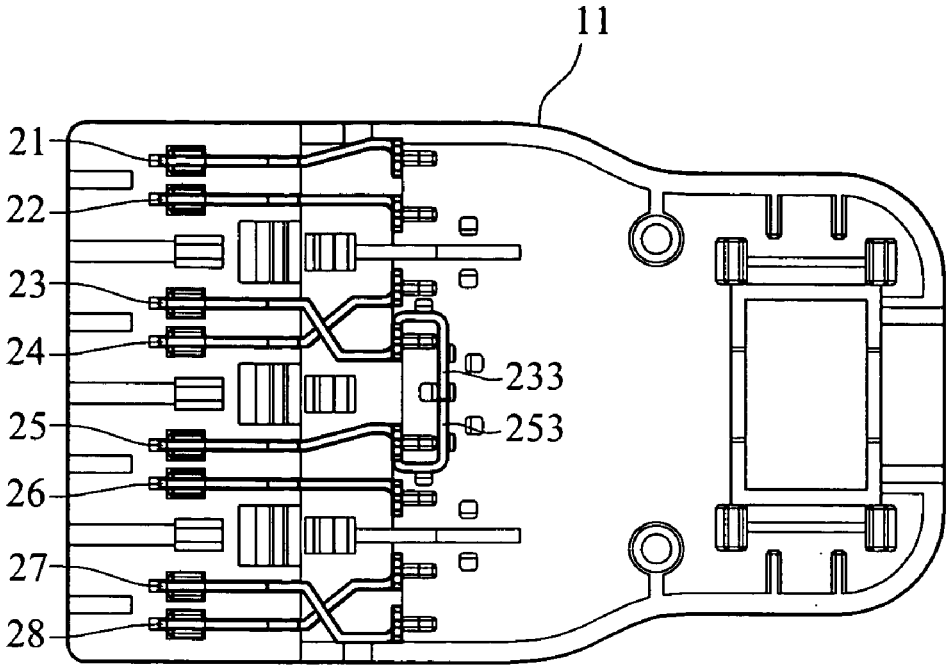
FIGS. 4A and 4B are schematic views of a third embodiment for capacitance compensation of the invention.
Figure 4B:
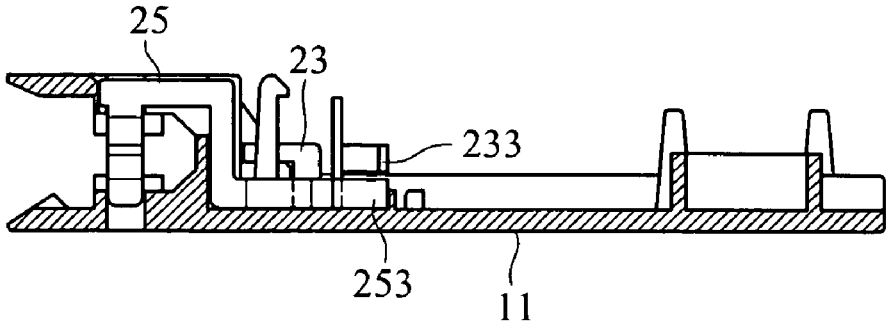

Referring to FIGS. 4A and 4B for a third embodiment of the invention, in which only the third electrical conductor 23 and the fifth electrical conductor 25 have respectively an extension 233 and 253. And instead of being located on the same horizontal level, they are in parallel and close to each other on a vertical surface. Variations may be made on the vertical surface the same as that on the horizontal surface. Details are omitted.

Figure 5:
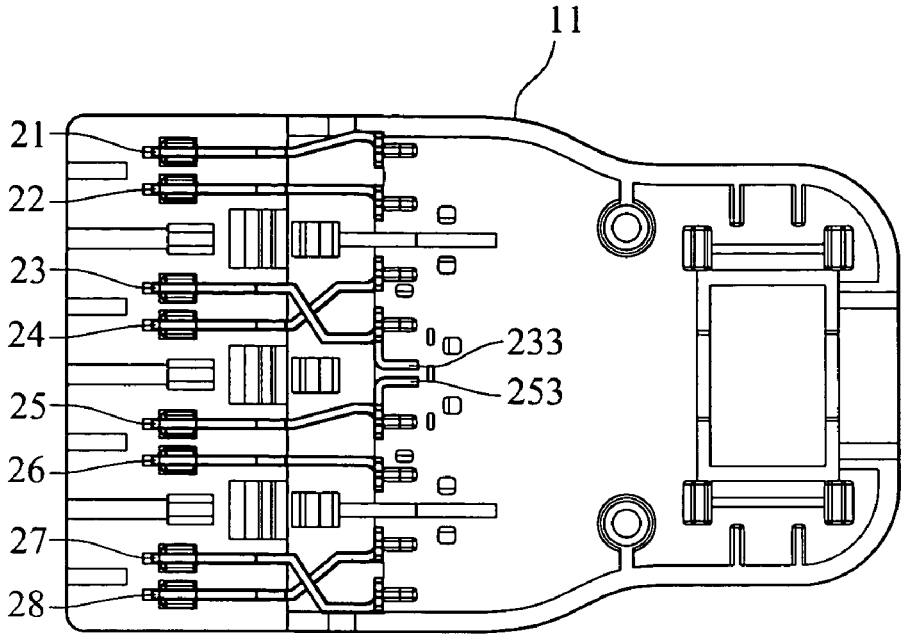
FIG. 5 is a schematic view of a fourth embodiment for capacitance compensation of the invention.

FIG. 5 illustrates a fourth embodiment of the invention. Only the third electrical conductor 23 and the fifth electrical conductor 25 have respectively an extension 233 and 253. They are located on the same horizontal level and extended longitudinally upwards in parallel, and close to each other.

Figure 6:
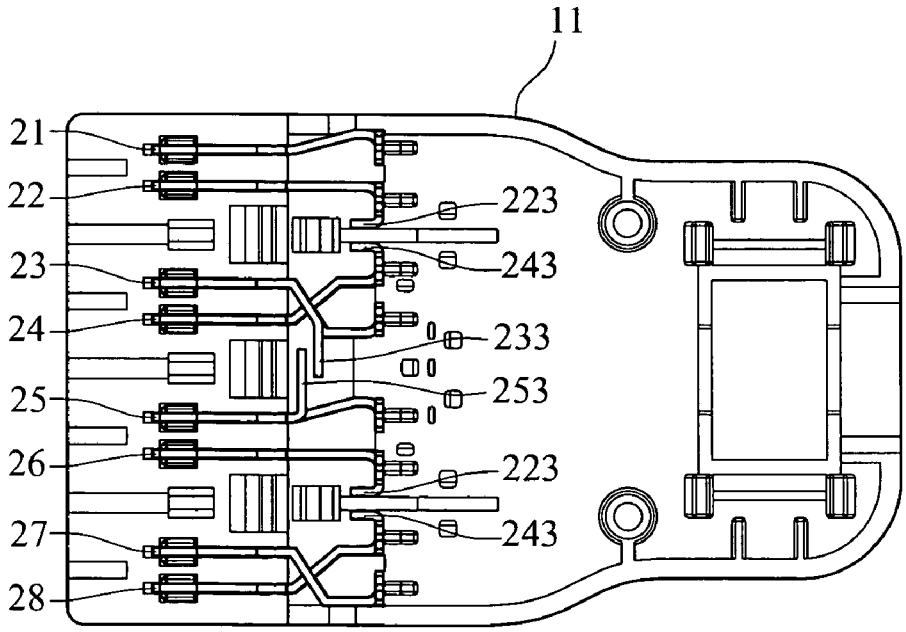
FIG. 6 is a schematic view of a fifth embodiment for capacitance compensation of the invention.

FIG. 6 illustrates a fifth embodiment of the invention. Aside from having the extension close to the piercing end as previously discussed, the extension may also be formed from a middle portion of the electrical conductor. As shown in the drawing, the third electrical conductor 23 and the fifth electrical conductor 25 have respectively an extension, 233 and 253, extended from the middle portion thereof. They are in parallel and close to each other in various fashions as the ones extending from the piercing ends.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments, which do not depart from the spirit and scope of the invention.

What is claimed is:

1. A patch plug for fastening a communication wire, comprising:

a shell having a housing space which has one end to receive the communication wire into the housing space and another end having a plurality of insertion slots formed thereon; and a plurality of electrical conductors located in the insertion slots having respectively one end formed a contact section exposed outside the housing space and another end formed a piercing end located in the housing space, the piercing end being connected to the communication wire, the electrical conductors being laid in pairs and spaced from one another according to different electricity, and being confined in the insertion slots in such a way that the interval of each pair of the electrical conductors is smaller than the interval of different pairs of the electrical conductors, and at least one pair of the electrical conductors having the piercing ends crossed to be abutting the piercing end of the same electricity of the electrical conductors of a neighboring pair to generate capacitance compensation.

2. The patch plug of claim 1, wherein the shell includes a base and a cap.

3. The patch plug of claim 1, wherein the piercing ends of the electrical conductors that have the same electricity are close to each other and in parallel with each other spatially to generate the capacitance compensation.

4. The patch plug of claim 3, wherein the piercing ends that are close to each other have a distal end forming an extension which is in parallel with each other spatially and close to each other to generate the capacitance compensation.

5. The patch plug of claim 4, wherein the extensions are in parallel on a same vertical surface.

6. The patch plug of claim 4, wherein the extensions are in parallel on a same horizontal surface.

7. The patch plug of claim 6, wherein the extensions are on the same horizontal surface and in parallel transversely.

8. The patch plug of claim 6, wherein the extensions are on the same horizontal surface and in parallel longitudinally.

9. The patch plug of claim 1, wherein the electrical conductors have an extension proximate a middle portion thereof that is in parallel spatially and close to each other to generate the capacitance compensation.

10. The patch plug of claim 9, wherein the extensions are in parallel on a same vertical surface.

11. The patch plug of claim 9, wherein the extensions are in parallel on a same horizontal surface.

12. The patch plug of claim 11, wherein the extensions are on the same horizontal surface and in parallel transversely.

13. The patch plug of claim 11, wherein the extensions are on the same horizontal surface and in parallel longitudinally.

* * * * *